US007093775B1

(12) United States Patent
Bingham

(10) Patent No.: US 7,093,775 B1
(45) Date of Patent: Aug. 22, 2006

(54) FRAGRANCE-DISPENSING SHOWER HEAD

(76) Inventor: Travis D. Bingham, 189 Middle School Rd., Jackson, TN (US) 38305

( * ) Notice: Subject to any disclaimer, the term of this patent is extended or adjusted under 35 U.S.C. 154(b) by 0 days.

(21) Appl. No.: 10/972,220

(22) Filed: Oct. 25, 2004

(51) Int. Cl.
*A62C 13/62* (2006.01)

(52) U.S. Cl. ..... 239/302; 310/315; 310/323; 310/327; 310/409

(58) Field of Classification Search ..... 239/302, 239/303, 304, 310, 323, 327, 398, 428, 313, 239/315, 330, 407, 409, 413, 418
See application file for complete search history.

(56) References Cited

U.S. PATENT DOCUMENTS

| | | | | | |
|---|---|---|---|---|---|
| 2,609,232 | A | * | 9/1952 | Taulman | 239/305 |
| 3,623,638 | A | * | 11/1971 | Henning et al. | 222/78 |
| 3,788,553 | A | * | 1/1974 | Heckman | 239/315 |
| 3,907,203 | A | * | 9/1975 | Skillings | 239/314 |
| 3,964,686 | A | * | 6/1976 | Lopez | 239/74 |
| 4,085,868 | A | | 4/1978 | Blair | |
| 4,218,013 | A | * | 8/1980 | Davison | 239/74 |
| 4,225,085 | A | | 9/1980 | Headen et al. | |
| 4,921,171 | A | * | 5/1990 | Cupit | 239/314 |
| D328,944 | S | | 8/1992 | Robbins | |
| D372,762 | S | * | 8/1996 | Braswell | D23/228 |
| 6,006,374 | A | * | 12/1999 | Winnett et al. | 4/525 |
| 6,036,110 | A | | 3/2000 | Kanatzar et al. | |
| 6,419,166 | B1 | | 7/2002 | Brzezinski et al. | |
| 2002/0070293 | A1 | | 6/2002 | Ti | |

* cited by examiner

*Primary Examiner*—David A. Scherbel
*Assistant Examiner*—Seth Barney

(57) ABSTRACT

A fragrance dispensing shower head apparatus includes a shower head including proximal and distal end portions and a central bore extending therebetween. The proximal end portion has a threaded inner surface. The shower head further includes a wire-mesh screen traversing water flow such that foreign debris can be sustained upstream of the distal end portion. A mechanism is included for ejecting a quantity of the fragrance into the bore and includes a plurality of reservoirs for holding the fragrance. The reservoirs introduce the fragrance adjacent to the distal end portion and have substantially similar shapes.

9 Claims, 4 Drawing Sheets

FRAGRANCE-DISPENSING SHOWER HEAD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a shower head and, more particularly, to a fragrance-dispensing shower head.

2. Prior Art

The use of shower heads is well known in the prior art. Such shower heads are generally used to dispense water in a steady stream onto a person in the shower for bathing. Typical shower heads however, do not provide a way to dispense alternate fluids therethrough, such as fragrant oils and lotions. Thus, a person must expend extra time and effort to apply these fluids manually to themselves.

It is often desirable to mix with a stream of water, liquids or dissolved particulate matter in order to benefit from the combination or mixture produced by the liquid and the water. This may be advantageous when, for example, a person is showering, and creams or conditioners are desired to enhance skin care, hair care etc. By introducing a steady and consistent amount of liquid or dissolved particulate matter into the water stream, an even and consistent application may be achieved much more readily than if the liquid is used in concentrated form and applied by the hands.

It has been proposed in the past to mix bath oil with water passing through a shower head by aspirating it into the shower line at a point upstream of the head. These systems, to date, have not found wide acceptance because they are extremely sensitive to water flow rate and rely on the differential between atmospheric pressure and the pressure of the flowing water at the point of aspiration. This differential can be quite small at low flow rates. In addition, the line constriction required to produce good aspiration objectionably limits the maximum delivery rate of the shower line. Furthermore, the current available systems are prone to clogging.

Accordingly, a need remains for a fragrance-dispensing shower head in order to overcome the above-noted shortcomings. The present invention satisfies such a need by providing a shower head that is practical, efficient, provides considerable time savings, is easy to install and durable. Such a fragrance-dispensing shower head provides a person with a quick and effortless way to cleanse the body, as well as releases fragrant oils onto the body. The shower head further advantageously eliminates the need for separate bars of soap, bottles of liquid soap or lotion, or washcloths, which tend to clutter a shower stall. The oils dispensed by the shower head lift a person's mood, dispel negative emotions, and create a romantic atmosphere. Such a fragrance-dispensing shower head will be appreciated by not only homeowners, but may also find application in gyms, health clubs, hotels, hospitals, nursing homes and motels.

BRIEF SUMMARY OF THE INVENTION

In view of the foregoing background, it is therefore an object of the present invention to provide a fragrance-dispensing shower head. These and other objects, features, and advantages of the invention are provided by an apparatus attachable to a water supply source for mixing a selected quantity of fragrance with water during operating conditions.

The apparatus includes a shower head including oppositely spaced proximal and distal end portions and a central bore extending therebetween for directing water outwardly from the distal end portion. Such a proximal end portion has a threaded inner surface for being removably connected to the water supply source and for advantageously providing a substantially water-tight seal. The shower head has an integrally disposed central portion diverging away from the proximal end portion such that the distal end portion has a greater diameter than the proximal end portion. Such a shower head includes a wire-mesh screen traversing water flow such that foreign debris can advantageously be sustained upstream of the distal end portion.

A mechanism is included for selectively ejecting a quantity of the fragrance into the bore for mixing with the water upstream of the distal end portion. Such an ejecting mechanism includes a plurality of reservoirs for holding the fragrance and is in fluid communication with the shower head for introducing the fragrance along a travel path substantially orthogonal to the flow of water. The reservoirs introduce the fragrance adjacent to the distal end portion so that the fragrance can be injected into a maximum water volume prior to exiting the shower head. Such reservoirs have substantially similar shapes and are preferably provided with an inlet port for selectively receiving fragrance therein. Each such inlet port preferably has an associated filler cap removably attached thereto.

In a first embodiment, the shower head has an outer surface provided with a plurality of passageways spaced about a circumference thereof. Such reservoirs are formed from resilient material and are connected to the shower head outer surface wherein the reservoirs extend inwardly through the passageways respectively. Each of the reservoirs includes a spring-loaded dispensing pin centrally positioned therein and further has a plurality of apertures axially formed along a length thereof such that the fragrance can conveniently be channeled through the apertures and deposited away from the reservoirs. Such spring-loaded pins are preferably resiliently compressible along a linear path when a user exerts an external force inwardly against the reservoirs respectively.

In an alternate embodiment, the shower head is provided with a substantially annular cavity formed adjacent to the distal end portion and centered about the bore. Such a cavity has an outlet in fluid communication with the bore and the reservoirs respectively. Advantageously, such reservoirs may each house alternate fragrances.

Such an embodiment includes the ejecting mechanism and further includes a housing connected to the reservoirs. The ejecting mechanism further includes a plurality of pumps operably connected to the conduit for advantageously allowing a user to selectively dispense the alternate fragrances as desired.

Such a housing further includes a fastening member attached to a top end portion thereof for being conveniently positioned about a selected portion of the water supply source such that the reservoirs can be spaced from the shower head while being maintained at a substantially stable position.

A flexible conduit is included having opposed end portions respectively connected to the reservoirs and the cavity for conveniently directing the fragrance therebetween during operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
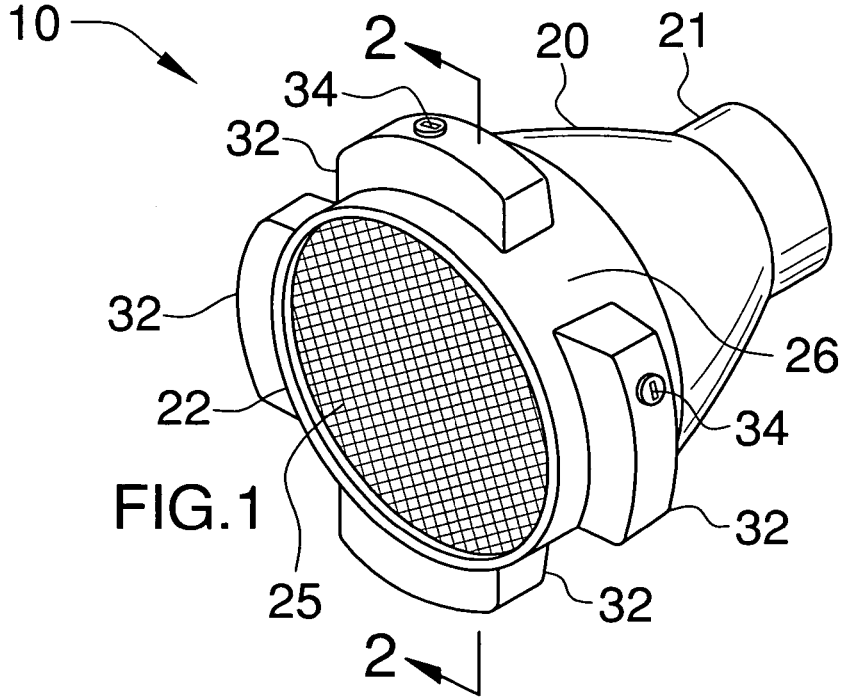
FIG. 1 is a perspective view showing a first embodiment of a fragrance-dispensing shower head, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to like elements in alternate embodiments.

The apparatus of this invention is referred to generally in FIGS. 1–8 by the reference numeral 10 and is intended to provide a fragrance-dispensing shower head. It should be understood that the apparatus 10 may be used to dispense many different types of liquids and should not be limited to only fragrant oils.

Referring initially to FIG. 1, the apparatus 10 includes a shower head 20 including oppositely spaced proximal 21 and distal 22 end portions and a central bore 23 extending therebetween for directing water outwardly from the distal end portion 22. Such a proximal end portion 21 has a threaded inner surface 24 for being removably connected to the water supply source 60 and for advantageously providing a substantially water-tight seal.

The threaded inner surface 24 advantageously allows the shower head 20 to be detached from one water supply source 60 and attached to another water supply source 60 in a different shower, thus allowing a user to experience the benefits of the apparatus 10 even when they are away from home. The shower head 20 has an integrally disposed central portion diverging away from the proximal end portion 21 such that the distal end portion 22 has a greater diameter than the proximal end portion 22. Such a shower head 20 includes a wire-mesh screen 25 traversing water flow such that foreign debris can advantageously be sustained upstream of the distal end portion 22 and not clog the shower head 20.

Referring to FIGS. 1, 2, 3, and 4, a mechanism 30 is included for selectively ejecting a quantity of the fragrance 31 into the bore 23 for mixing with the water upstream of the distal end portion 22. Such an ejecting mechanism 30 includes a plurality of reservoirs 32 for holding the fragrance 31 and is in fluid communication with the shower head 20 for introducing the fragrance 31 along a travel path substantially orthogonal to the flow of water. The reservoirs 32 introduce the fragrance 31 adjacent to the distal end portion 22 so that the fragrance 31 can be injected into a maximum water volume prior to exiting the shower head 20, thus ensuring that the fragrance 31 is not too concentrated and irritating, but pleasing and soothing to the individual's senses.

Such reservoirs 32 have substantially similar shapes and are provided with an inlet port 33 for selectively receiving fragrance 31 therein such that the reservoirs 32 may conveniently be refilled when all the fragrance 31 has been expelled. Each such inlet port 33 has an associated filler cap 34 removably attached thereto. The reservoirs 32 can each advantageously house an alternate fragrance 31, thus giving a user a choice between different scents depending on how they feel.

Figure 2:
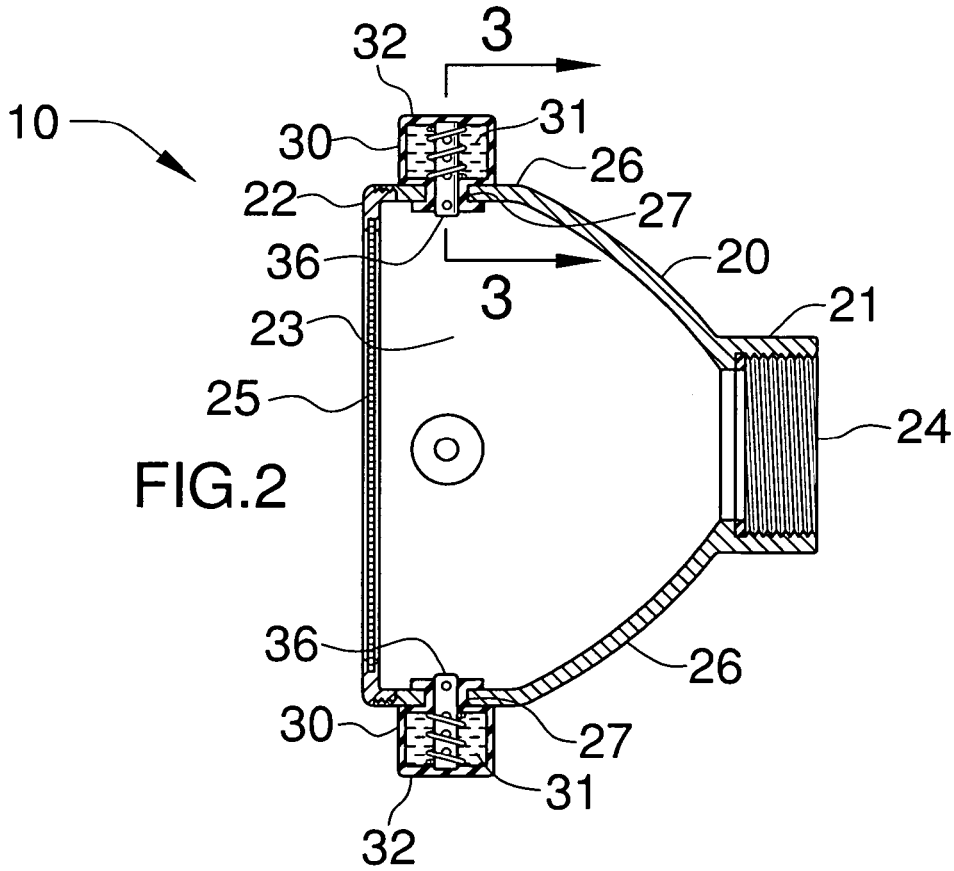
FIG. 2 is a cross-sectional view of the apparatus shown in FIG. 1, taken along line 2—2.
Figure 3:
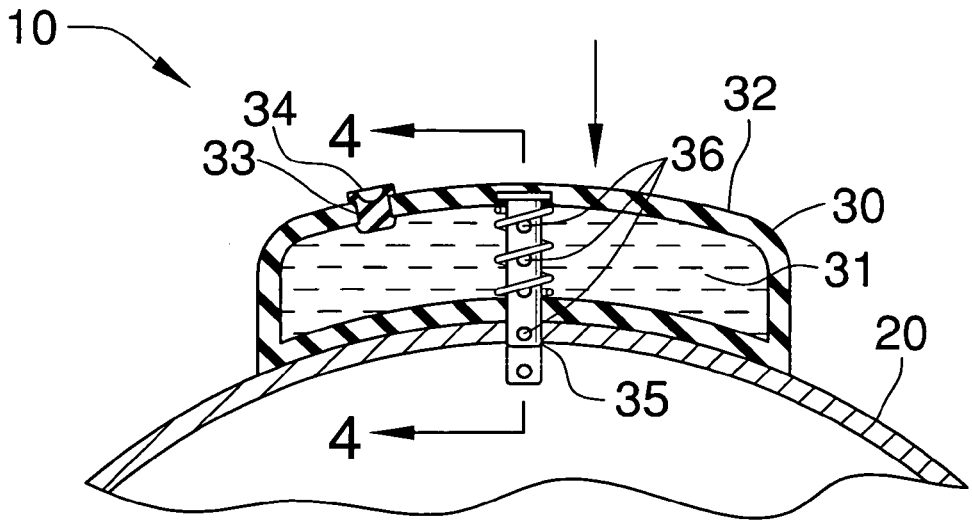
FIG. 3 is a cross-sectional view of the reservoir shown in FIG. 2, taken along line 3—3.
Figure 4:
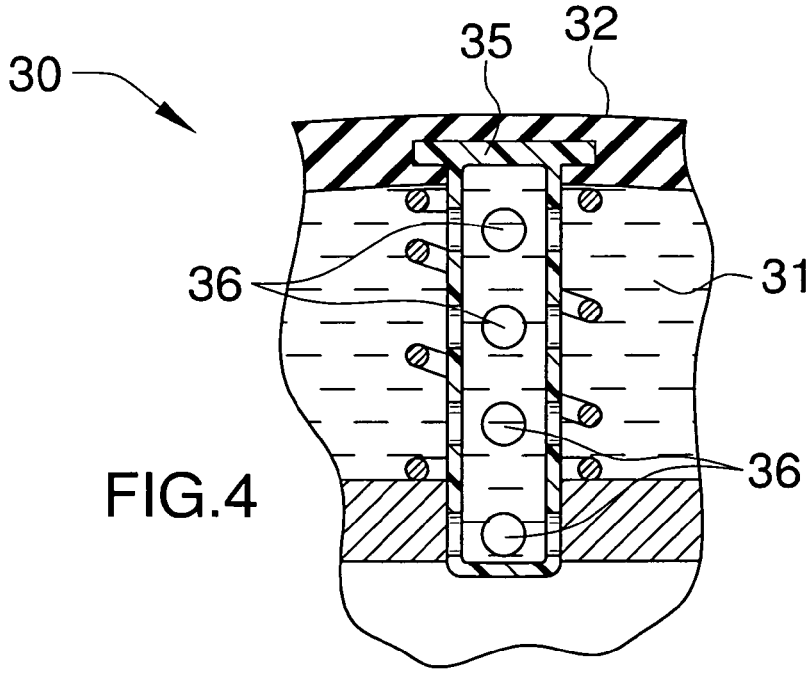
FIG. 4 is a cross-sectional view of the dispensing pin shown in FIG. 3, taken along line 4—4.

Referring to FIGS. 2, 3 and 4, in a first embodiment 10, the shower head 20 has an outer surface 26 provided with a plurality of passageways 27 spaced about a circumference thereof. The reservoirs 32 are formed from resilient material and are connected to the shower head outer surface 26 wherein the reservoirs 32 extend inwardly through the passageways 27 respectively. Each of the reservoirs 32 includes a spring-loaded dispensing pin 35 centrally positioned therein and further has a plurality of apertures 36 axially formed along a length thereof such that the fragrance 31 can conveniently be channeled through the apertures 36 and deposited away from the reservoirs 32. Such spring-loaded pins 35 are resiliently compressible along a linear path when a user exerts an external force inwardly against the reservoirs 32 respectively.

Figure 5:
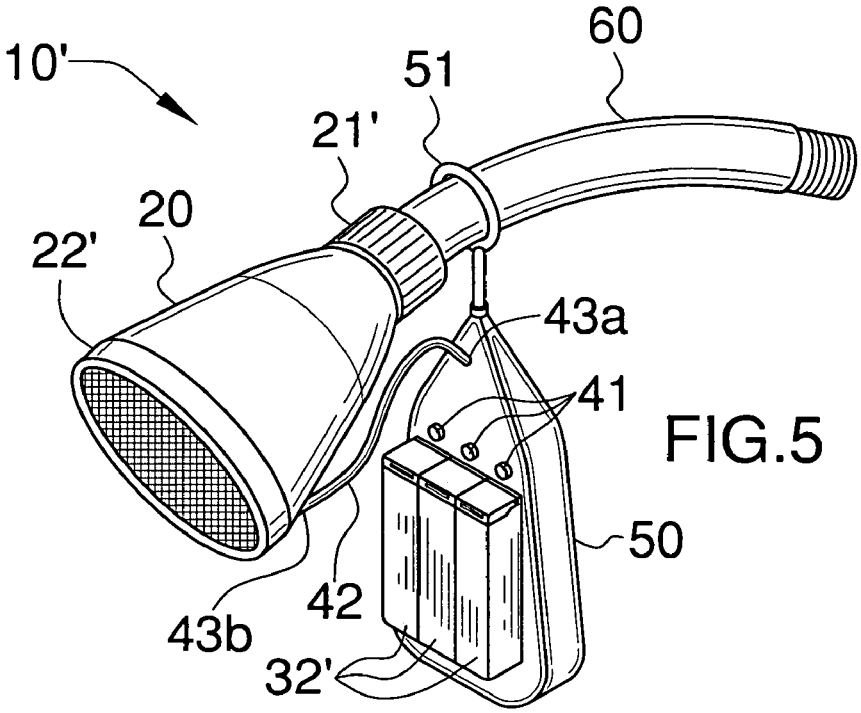
FIG. 5 is a perspective view showing an alternate embodiment of the fragrance dispensing shower head.
Figure 6:
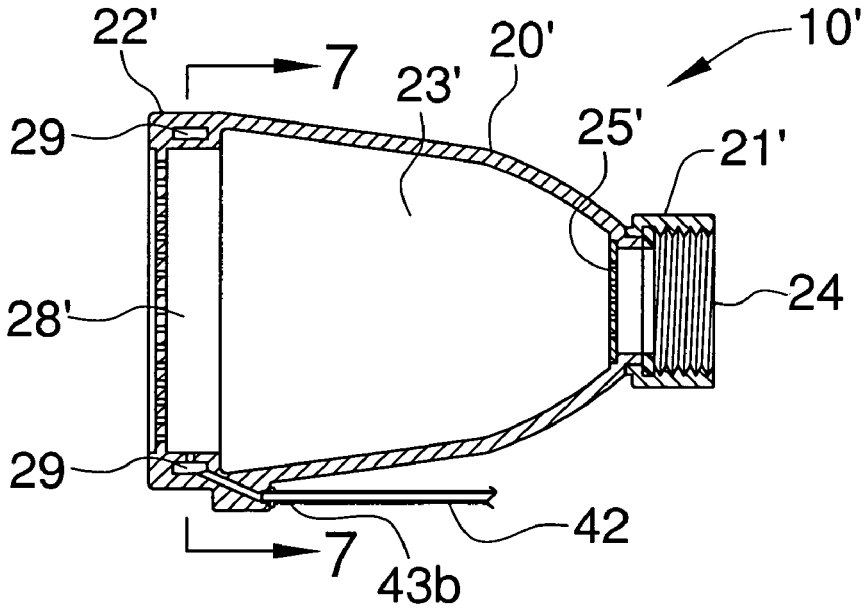
Figure 7:
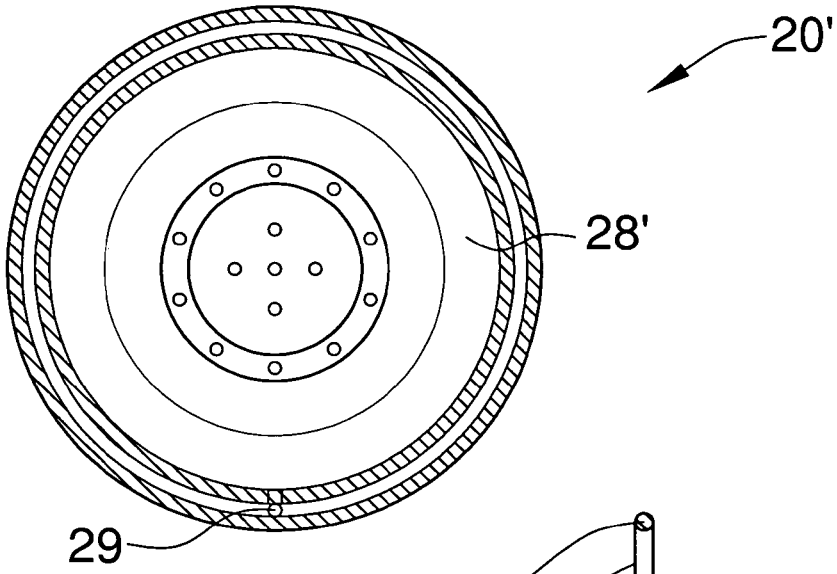
FIG. 7 is a cross-sectional view of the apparatus shown in FIG. 6, taken along line 7—7.

Referring to FIGS. 5, 6 and 7, in an alternate embodiment 10', the shower head 20' is provided with a substantially annular cavity 28' formed adjacent to the distal end portion 22' and centered about the bore 23'. Such a cavity 28' has an outlet 29' in fluid communication with the bore 23' and the reservoirs 32' respectively. Advantageously, such reservoirs 32' each house alternate fragrances 31.

Figure 8:
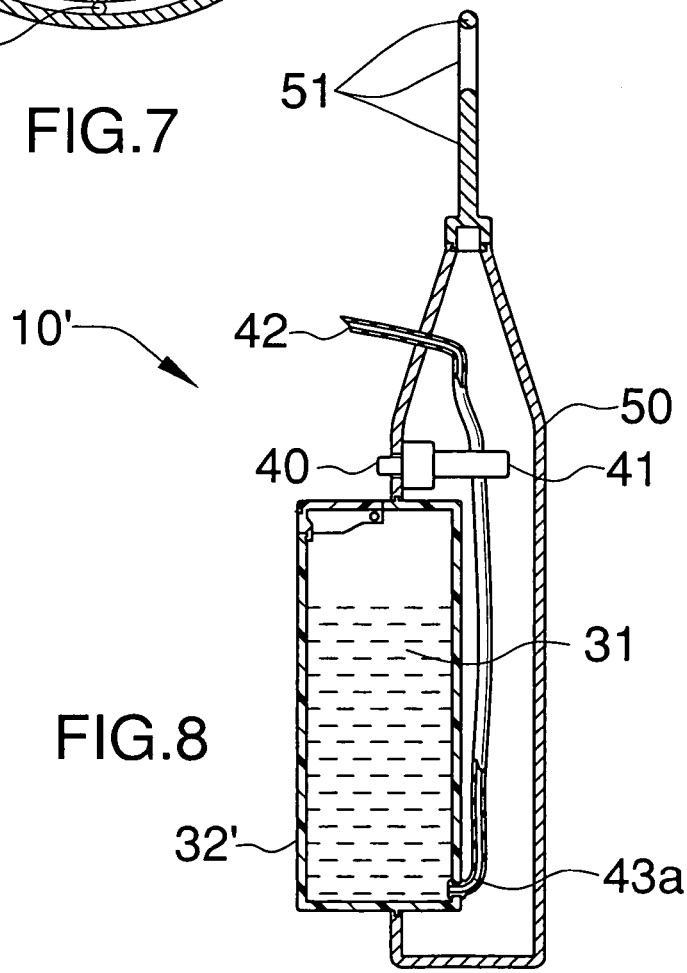
FIG. 8 is a cross-sectional view of the reservoirs shown in FIG. 5.

Referring to FIGS. 5 and 8, such an embodiment 10' includes the ejecting mechanism 40 and further includes a housing 50 connected to the reservoirs 32'. The ejecting mechanism 40 further includes a plurality of pumps 41 operably connected to the conduit 42 (described herein below) for advantageously allowing a user to selectively dispense the alternate fragrances 31 as desired. Still referring to FIGS. 5 and 8, such a housing 50 includes a fastening member 51 attached to a top end portion thereof for being conveniently positioned about a selected portion of the water supply source 60 such that the reservoirs 32' can be spaced from the shower head 20' while being maintained at a substantially stable position.

Referring to FIGS. 5, 6 and 8, a flexible conduit 42 is included having opposed end portions 43*a*, 43*b* respectively connected to the reservoirs 32' and the cavity 28' for conveniently directing the fragrance 31 therebetween during operating conditions.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An apparatus attachable to a water supply source for mixing a selected quantity of fragrance with water during operating conditions, said apparatus comprising;

a shower head including oppositely spaced proximal and distal end portions and a central bore extending therebetween for directing water outwardly from said distal end portion, said proximal end portion having a threaded inner surface for being removably connected to the water supply source and for providing a substantially water-tight seal, said shower head having an integrally disposed central portion diverging away from said proximal end portion such that said distal end portion has a greater diameter than said proximal end portion; and means for selectively ejecting a quantity of the fragrance into said bore for mixing with the water upstream of said distal end portion, said ejecting means comprising a plurality of reservoirs for holding the fragrance and being in fluid communication with said shower head for introducing the fragrance along a travel path substantially orthogonal to the flow of water, said reservoirs for introducing the fragrance adjacent said distal end portion so that the fragrance can be injected into a maximum water volume prior to exiting said shower head;

wherein said shower head has an outer surface provided with a plurality of passageways spaced about a circumference thereof, said reservoirs being formed from resilient material and being connected to said shower head outer surface wherein said reservoirs extend inwardly through said passageways respectively, each said reservoir comprising a spring-loaded dispensing pin centrally positioned therein and having a plurality of apertures axially formed along a length thereof such that the fragrance can be channeled through the apertures and deposited away from the reservoirs.

2. The apparatus of claim 1, wherein said spring-loaded pins are resiliently compressible along a linear path when a user exerts an external force inwardly against said reservoirs respectively.

3. The apparatus of claim 1, wherein said reservoirs are provided with an inlet port for selectively receiving fragrance therein, each said inlet port having an associated filler cap removably attached thereto.

4. An apparatus attachable to a water supply source for mixing a selected quantity of fragrance with water during operating conditions, said apparatus comprising:

a shower head including oppositely spaced proximal and distal end portions and a central bore extending therebetween for directing water outwardly from said distal end portion, said proximal end portion having a threaded inner surface for being removably connected to the water supply source and for providing a substantially water-tight seal, said shower head having an integrally disposed central portion diverging away from said proximal end portion such that said distal end portion has a greater diameter than said proximal end portion, said shower head comprising a wire-mesh screen traversing water flow such that foreign debris can be sustained upstream of said distal end portion; and means for selectively ejecting a quantity of the fragrance into said bore for mixing with the water upstream of said distal end portion, said ejecting means comprising a plurality of reservoirs for holding the fragrance and being in fluid communication with said shower head for introducing the fragrance along a travel path substantially orthogonal to the flow of water, said reservoirs for introducing the fragrance adjacent said distal end portion so that the fragrance can be injected into a maximum water volume prior to exiting said shower head;

wherein said shower head has an outer surface provided with a plurality of passageways spaced about a circumference thereof, said reservoirs being formed from resilient material and being connected to said shower head outer surface wherein said reservoirs extend inwardly through said passageways respectively, each said reservoir comprising a spring-loaded dispensing pin centrally positioned therein and having a plurality of apertures axially formed along a length thereof such that the fragrance can be channeled through the apertures and deposited away from the reservoirs.

5. The apparatus of claim 4, wherein said spring-loaded pins are resiliently compressible along a linear path when a user exerts an external force inwardly against said reservoirs respectively.

6. The apparatus of claim 4, wherein said reservoirs are provided with an inlet port for selectively receiving fragrance therein, each said inlet port having an associated filler cap removably attached thereto.

7. An apparatus attachable to a water supply source for mixing a selected quantity of fragrance with water during operating conditions, said apparatus comprising;

a shower head including oppositely spaced proximal and distal end portions and a central bore extending therebetween for directing water outwardly from said distal end portion, said proximal end portion having a threaded inner surface for being removably connected to the water supply source and for providing a substantially water-tight seal, said shower head having an integrally disposed central portion diverging away from said proximal end portion such that said distal end portion has a greater diameter than said proximal end portion, said shower head comprising a wire-mesh screen traversing water flow such that foreign debris can be sustained upstream of said distal end portion; and means for selectively ejecting a quantity of the fragrance into said bore for mixing with the water upstream of said distal end portion, said ejecting means comprising a plurality of reservoirs for holding the fragrance and being in fluid communication with said shower head for introducing the fragrance along a travel path substantially orthogonal to the flow of water, said reservoirs for introducing the fragrance adjacent said distal end portion so that the fragrance can be injected into a maximum water volume prior to exiting said shower head, said reservoirs having substantially similar shapes;

wherein said shower head has an outer surface provided with a plurality of passageways spaced about a circumference thereof, said reservoirs being formed from resilient material and being connected to said shower head outer surface wherein said reservoirs extend inwardly through said passageways respectively, each said reservoir comprising a spring-loaded dispensing pin centrally positioned therein and having a plurality of apertures axially formed along a length thereof such that the fragrance can be channeled through the apertures and deposited away from the reservoirs.

8. The apparatus of claim 7, wherein said spring-loaded pins are resiliently compressible along a linear path when a user exerts an external force inwardly against said reservoirs respectively.

9. The apparatus of claim 7, wherein said reservoirs are provided with an inlet port for selectively receiving fragrance therein, each said inlet port having an associated filler cap removably attached thereto.

* * * * *